US007424859B1

(12) United States Patent
Clancey

(10) Patent No.: US 7,424,859 B1
(45) Date of Patent: Sep. 16, 2008

(54) SHALLOW WATER BOAT

(75) Inventor: Timothy L. Clancey, Elmendorf, TX (US)

(73) Assignee: Pro-Line/New Water, Inc., San Antonio, TX (US)

( * ) Notice: Subject to any disclaimer, the term of this patent is extended or adjusted under 35 U.S.C. 154(b) by 0 days.

(21) Appl. No.: 12/037,604

(22) Filed: Feb. 26, 2008

(51) Int. Cl.
*B63H 5/16* (2006.01)

(52) U.S. Cl. ..... 114/289; 114/67 A; 440/68

(58) Field of Classification Search ..... 114/67 A, 114/289; 440/68
See application file for complete search history.

(56) References Cited

U.S. PATENT DOCUMENTS 1,877,380 A * 9/1932 Baldwin ..... 114/67 A
3,076,426 A * 2/1963 Alexander et al. ..... 440/46
3,203,389 A * 8/1965 Cale ..... 114/289
4,165,703 A * 8/1979 Burg ..... 114/67 A
4,231,314 A * 11/1980 Peters ..... 114/291
4,926,771 A * 5/1990 Hull ..... 114/289
4,941,423 A * 7/1990 Van Tassel ..... 114/289
5,456,201 A * 10/1995 Bobst ..... 114/289
6,125,781 A * 10/2000 White ..... 114/288

* cited by examiner

*Primary Examiner*—Stephen Avila
(74) *Attorney, Agent, or Firm*—Gunn & Lee, PC; Ted D. Lee

(57) ABSTRACT

A shallow water boat is shown that operates well in both shallow water and deep water. A tunnel is provided along a centerline of a flat bottom, which tunnel starts near amidships increases in depth and terminates at the aft of the shallow water boat. A top of the tunnel has an S curve therein. A front end of the tunnel connects through a series of angled holes into a plenum via a conduit to atmosphere above the maximum water line of the shallow water boat. During shallow water operation, the motor is raised and the conduit is plugged so water flows through the tunnel to the propeller for the motor. During deep water operation, the motor is lowered and the conduit unplugged so that water does not flow through the tunnel.

6 Claims, 7 Drawing Sheets

SHALLOW WATER BOAT

BACKGROUND OF THE INVENTION

1. Field of the Invention

This invention relates generally to boats and, more specifically, to a boat for alternatively operating in shallow water or at high speeds in deep water.

2. Background of the Prior Art

Various types of boats, ships or vessels have been used from the earliest recorded history of man. Different type boats have different functions. One boat may be designed for speed and another boat designed for hauling heavy loads. Likewise, boats may be designed for operation in shallow water versus deep water or in the ocean. Some boats are designed for maneuverability and others are designed for holding a straight line.

Fishing, whether as sport or as a means of making a living, is very popular throughout the world. While fishing can be performed from the banks, the best fishing is normally performed from boats operated either near the shore or in shallow water of bays or marshes which would normally have fish. To operate in such an environment, the boat should be maneuverable, but have the minimum amount of draft. Typically, some type of flat bottom boat best meets these requirements. However, getting to and from the good fishing areas from a suitable dock or put in location normally requires traveling some distance over open water. The traveling over open waters requires a boat having different characteristics than a boat that operates well in shallow waters. For example, to get to bays and inlets along the coast, it may be necessary to travel over open waters of the ocean or at least extended distances over inland ship channels. If the boat is designed entirely for shallow waters the time and efficiencies for traveling to and from various fishing points can be long and expensive.

It has been found that some type of hybrid between the shallow water boat and the deep water boat is necessary for most ideal conditions. One of the hybrid type boats that has been developed has been a tunnel-hull boat as shown in U.S. Pat. No. 6,125,781 by White. In White's tunnel-hull boat, a pointed bow is provided to cut through the waves when under way. A relatively flat bottom provides for a minimum draft to keep the motor from having to extend below the bottom of the boat when under way in shallow water. A tunnel is provided in the aft of the boat. The tunnel is straight and enlarging from the amidship to the aft of the boat. The tunnel draws water up to the propeller of the outboard motor when the boat is underway in shallow water as shown in White.

Further, White shows aeration with apertures to provide air at the beginning of the tunnel to reduce friction. However, the design as shown in White still has problems. The motor operates at the same depth in both shallow or deep water. Water is drawn up the tunnel when the boat is underway whether in shallow or deep water. The air being introduced at the entrance of the tunnel simply is used to reduce friction, not to cause separation between the water and the tunnel. The straight and enlarging design of the tunnel also does not induce separation of the water from the tunnel when operating at high speeds in deep water. A boat built in accordance with White never gets total separation between the water and tunnel even when the boat is operating at high speeds in open water.

SUMMARY OF THE INVENTION

It is an object of the present invention to provide a shallow water boat that will operate efficiently in deep water.

It is another object of the present invention to provide a shallow water boat that is maneuverable in shallow water, yet handles well in deep and open water.

It is yet another object of the present invention to provide a shallow water boat that has a partial tunnel to draw water into the tunnel when operating in shallow water, but not when operating in deep water.

It is still another object of the present invention to provide a shallow water boat with a tunnel that starts at approximately the amidship location in the hull with an unplugable openings at the beginning of the tunnel to cause separation between the water and the tunnel when operating in water.

It is a further object of the present invention to provide a tunnel in the hull of a flat bottom boat for use in shallow water, which tunnel starts at the amidship location and has a slight S shape top therein. At the beginning of the tunnel, a plenum connects through a series of holes to allow air to be drawn through venturi action into the beginning of the tunnel, which air causes a separation between water moving into the tunnel and the tunnel. The plenum may be connected (or disconnected) to a source of air. When the plenum is connected to a source of air, due to the venturi suction, air is drawn into the tunnel rather than water. This allows the boat to be operated more efficiently in open water, at which point the motor will be lowered down into the water below the bottom of the boat. However, when the plenum is not connected to a source of air, surface tension draws water moving across the bottom of the boat up into the tunnel. Because the tunnel is located in the center of the boat, the aft end of the boat and tunnel terminate in front of the propeller for the motor. The motor may be raised up above the bottom of the boat, but the propeller still strikes the water that is drawn through the tunnel. In this manner, the boat can operate and maneuver in very shallow water without the propeller or motor extending below the hull of the boat.

It helps to have a proliferation of holes connecting through the hull of the boat from the plenum to the beginning of the tunnel so that a complete separation of the water from the tunnel is accomplished when operating in deep water. Also, having a slight S curve in the top of tunnel further insures the complete separation of water from the tunnel. This allows the motor and propeller to be lowered down into the water when operating in open water, but raise when operating in shallow water. Also, the tunnel is not a traditional V-shape, but has a flat upper surface with rounded corners. The flat upper surface has the slight S shape to (1.) insure complete separation of water from the tunnel when connected to a source of air, but (2.) stay attached in laminar flow fashion when not connected to a source of air.

DESCRIPTION OF THE PREFERRED EMBODIMENT

Figure 1:
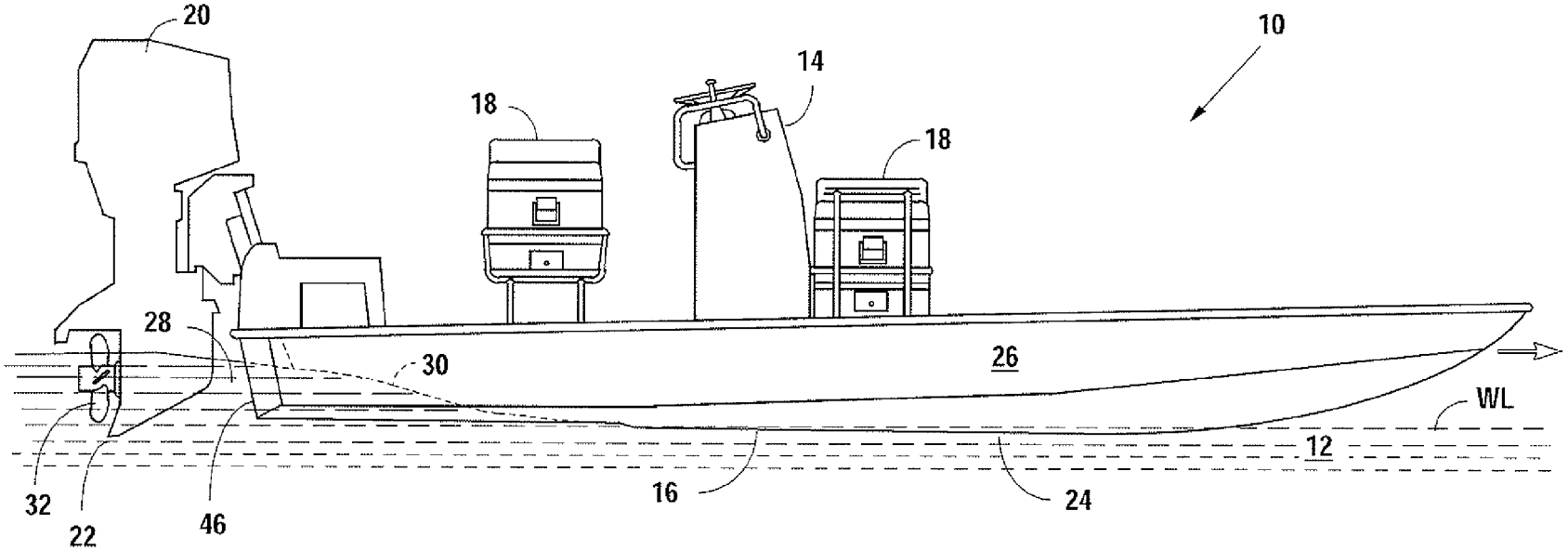
FIG. 1 is a side view of a shallow draft boat operating in shallow water utilizing the present invention.

Referring to FIG. 1 of the drawings, a shallow draft boat 10 is shown in shallow water 12 that has a water line WL as the boat moves forward in the direction indicated by the arrow. The shallow draft boat 10 has the helm 14 mounted at approximately amidship 16 on the deck (not shown) of the shallow draft boat 10. Seating 18 is also provided on the deck (not shown) of the shallow draft boat 10.

In the view as shown in FIG. 1, the outboard motor 20 is in a raised position so that the lower portion 22 of the outboard motor 20 is approximately level with the bottom 24 of the hull 26 of the shallow draft boat 10. As the shallow draft boat 10 moves forward, a ridge 28 of water follows a tunnel 30 in a matter described hereinbelow to strike the propeller 32 of the outboard motor 20. The spinning of the propeller 32 in the ridge 28 of the shallow water 12 provides the forward motion for the shallow draft boat 10.

Figure 2:
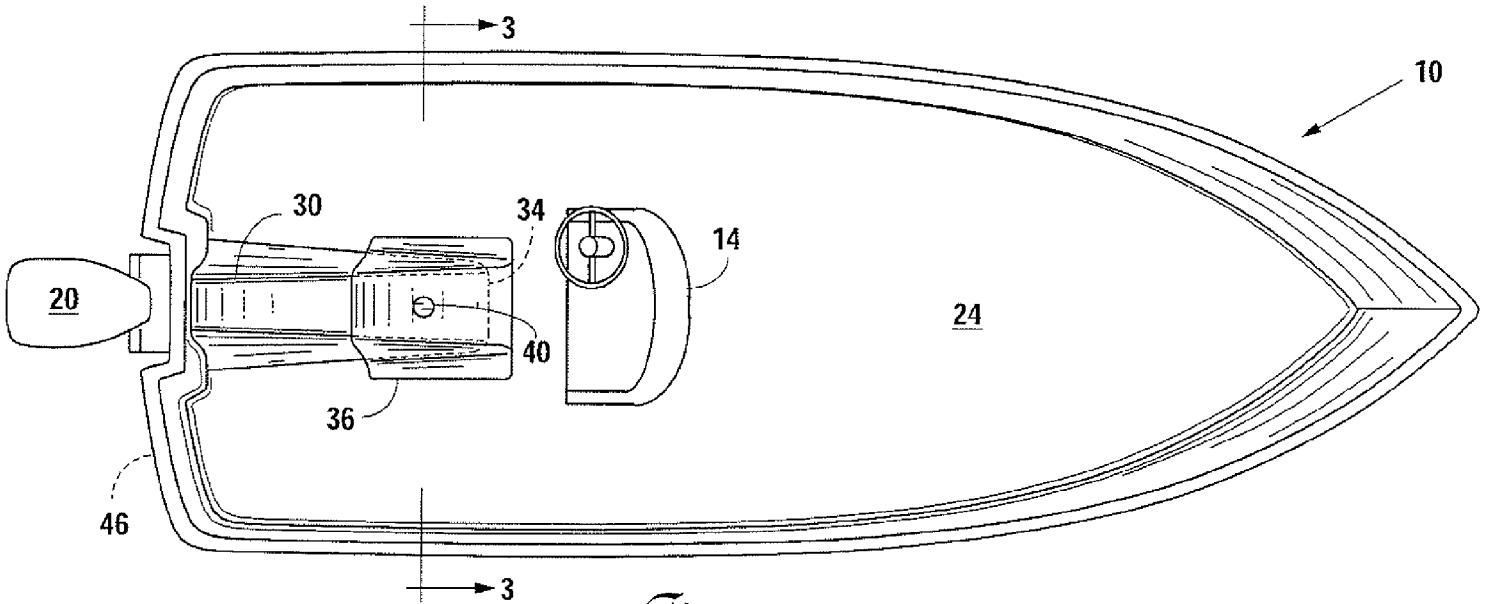
FIG. 2 is a top view of FIG. 1, but with the deck and seating removed.
Figure 3:
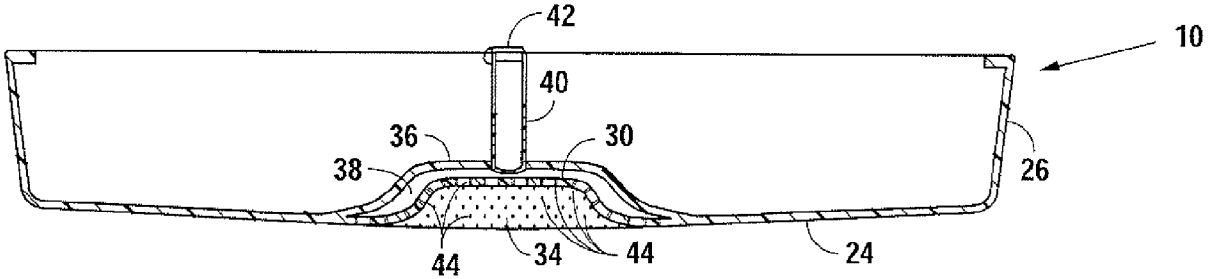
FIG. 3 is a cross-sectional view of FIG. 2 along section lines 3-3.

Referring now to FIGS. 2 and 3 in combination, the shallow draft boat 10 is shown with the deck removed as well as the seating 18. The helm 14 remains in place for illustration purposes only. Rising out of the bottom 24 of the hull 26 is the tunnel 30. The forward end 34 of the tunnel 30 is enclosed in a plenum 36. The plenum 36 forms an air space 38 over the forward end 34 of the tunnel 30. The air space 38 is connected to the atmosphere by vertical conduit 40. By removing the stopper 42 from the vertical conduit 40, direct access to the atmosphere is provided to air space 38.

Below the plenum 36 in the forward end 34 of tunnel 30 is a proliferation of angled holes extended through the bottom 24 of the hull 26. Motor 20 is mounted on the transom 46 of the shallow draft boat 10.

Assume the shallow draft boat 10 is in deep water 48 and traveling at a good speed such as fishermen do when traveling to or from a fishing location. The outboard motor 20 will be lowered on the transom 46 so that the lower portion 22 and propeller 32 extend well below the bottom 24 of the hull 26 of the shallow draft boat 10 into deep water 48 (see FIGS. 4A and 4B). As the shallow draft boat 10 moves in the direction indicated by the arrow in FIG. 4A, the water line WL in the deep water 48 is as indicated with no water being drawn in to the tunnel 30. The reason no water is drawn into the tunnel 30 is because the stopper 42 has been removed from the vertical conduit 40 which allows air to flow into the air space 38 created by the plenum 36 because of the proliferation of angle holes 44 that are directed towards the aft of the shallow draft boat 10. As the deep water 48 moves across the angle holes 44 venturi action is created to suck air out of the air space 38 and through the vertical conduit 40. The air being drawn in through the angled holes 44 into tunnel 30 causes the deep water 48 to separate from the top 50 of the tunnel 30 by relieving the surface tension therebetween. The stopper 42 can be replaced by any type control valve the boat owner may desire including a fully automated electrical control valve.

Figure 4B:
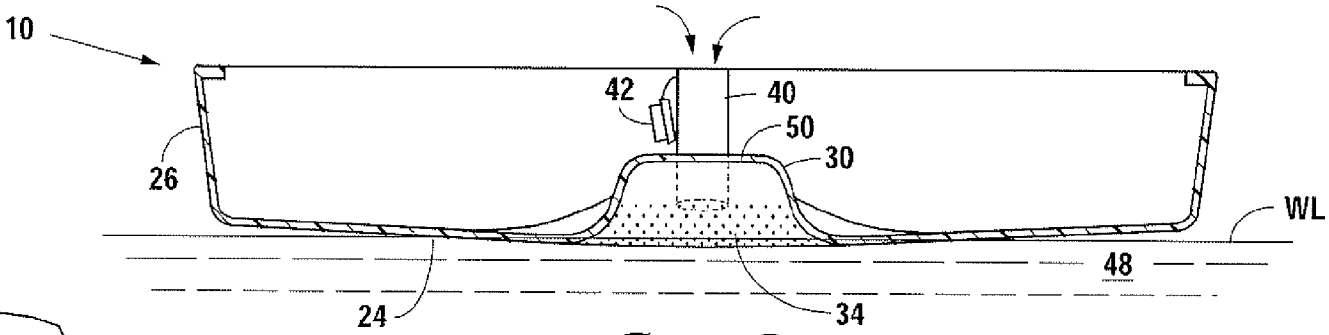
FIG. 4B is a cross-sectional view of FIG. 4A along section lines 4B-4B.
Figure 4A:
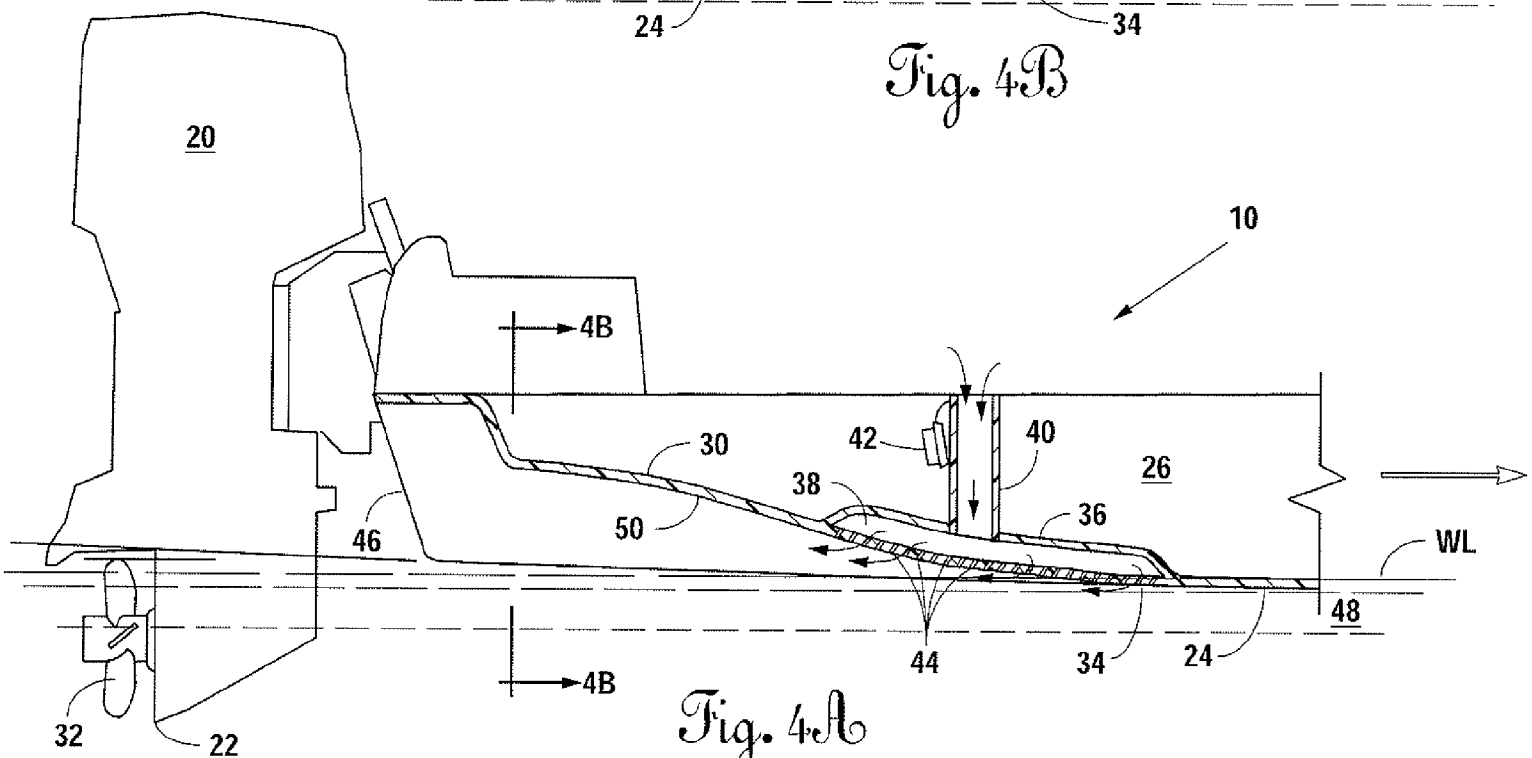
FIG. 4A is a partial longitudinal sectional view of a boat utilizing the present invention and operating in deep water, but the deck removed.

The top 50 of the tunnel 30 is generally flat except for a slight S curve contained therein as can be seen FIG. 4A. When the stopper 42 is removed, the S curve further aids in breaking the surface tension between the top 50 of the tunnel 30 and the deep water 48. By the combination of the S curve in the top 50 and the drawing of air through the venturis created by the angled holes 44, deep water 48 is not drawn into the tunnel 30. By not drawing deep water 48 into the tunnel 30, the laminar flow is broken and surface tension is eliminated in the tunnel 30. Therefore, the shallow draft boat 10 will operate more efficiently in deep water 48. This is particularly desirable for fisherman traveling to and from their put in point or dock to their fishing location. Hence, it will require less fuel and time to get to, or return from, a fishing location which is typically in shallow water that may be found in bays, bayous, marshes, coves, inlets, or shallow flats. Also favorite fishing locations may include reefs, sand bars or sunken ships. When traveling in deep water at a good speed, the shallow draft boat 10 will plane with the water line WL as shown in FIGS. 4A and 4B.

Figure 5B:
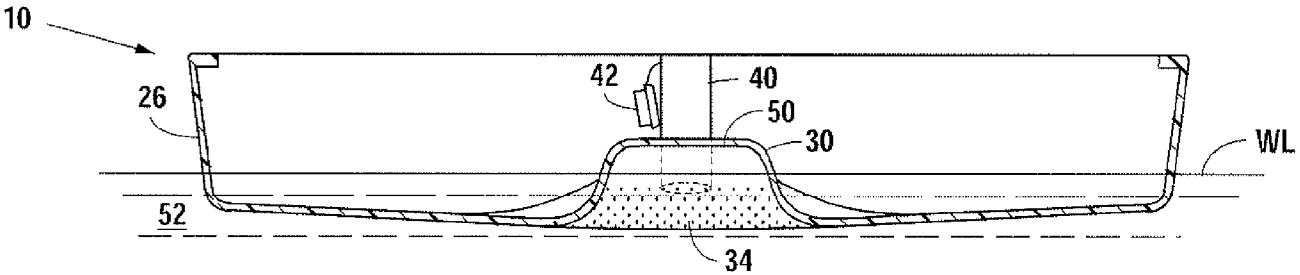
FIG. 5B is a cross-sectional view of FIG. 5A along section lines 5B.
Figure 5A:
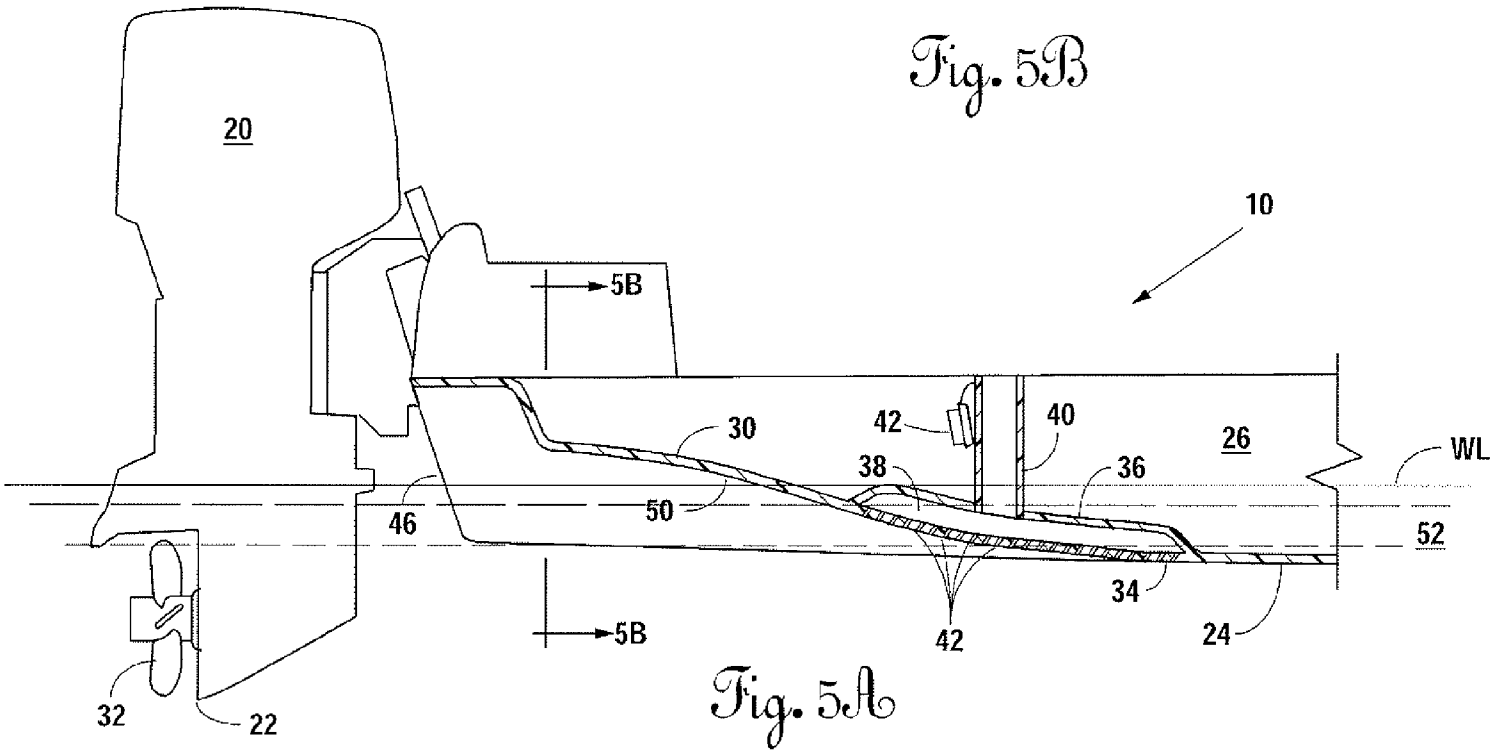
FIG. 5A is a partial longitudinal section view of a boat utilizing the present invention setting still in deep water, but with the deck removed.

When the shallow draft boat 10 is fully loaded and sitting still in the water with the stopper 42 of the vertical conduit 40 is removed, it is important that the vertical conduit 40 extend above the water line WL. Referring to FIGS. 5A and 5B in combination, the shallow draft boat 10 is shown still in the water 52. Water 52 may either be shallow water or deep water. The water line WL rises on the hull 26 of the shallow water boat 10 as shown. If the stopper 42 is removed from the vertical conduit 40, water 52 will rise through the angled holes 42, the air space 38 of plenum 36 into the vertical conduit 40. In the view as shown in FIG. 5A, the outboard motor 20 is in the lowered position with the lowered portion 22 and propeller 32 extending below the bottom 24 of the hull 26 as if the shallow draft boat 10 is in deep water. However, the outboard motor 20 could be in the raised position and the shallow draft boat 10 could be in shallow water.

Figure 6B:
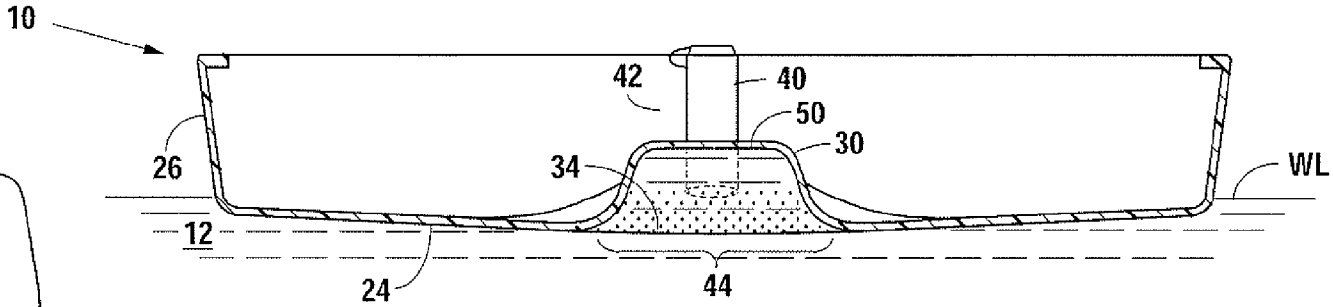
FIG. 6B is a cross-sectional view of FIG. 6A along section lines 6B-6B.
Figure 6A:
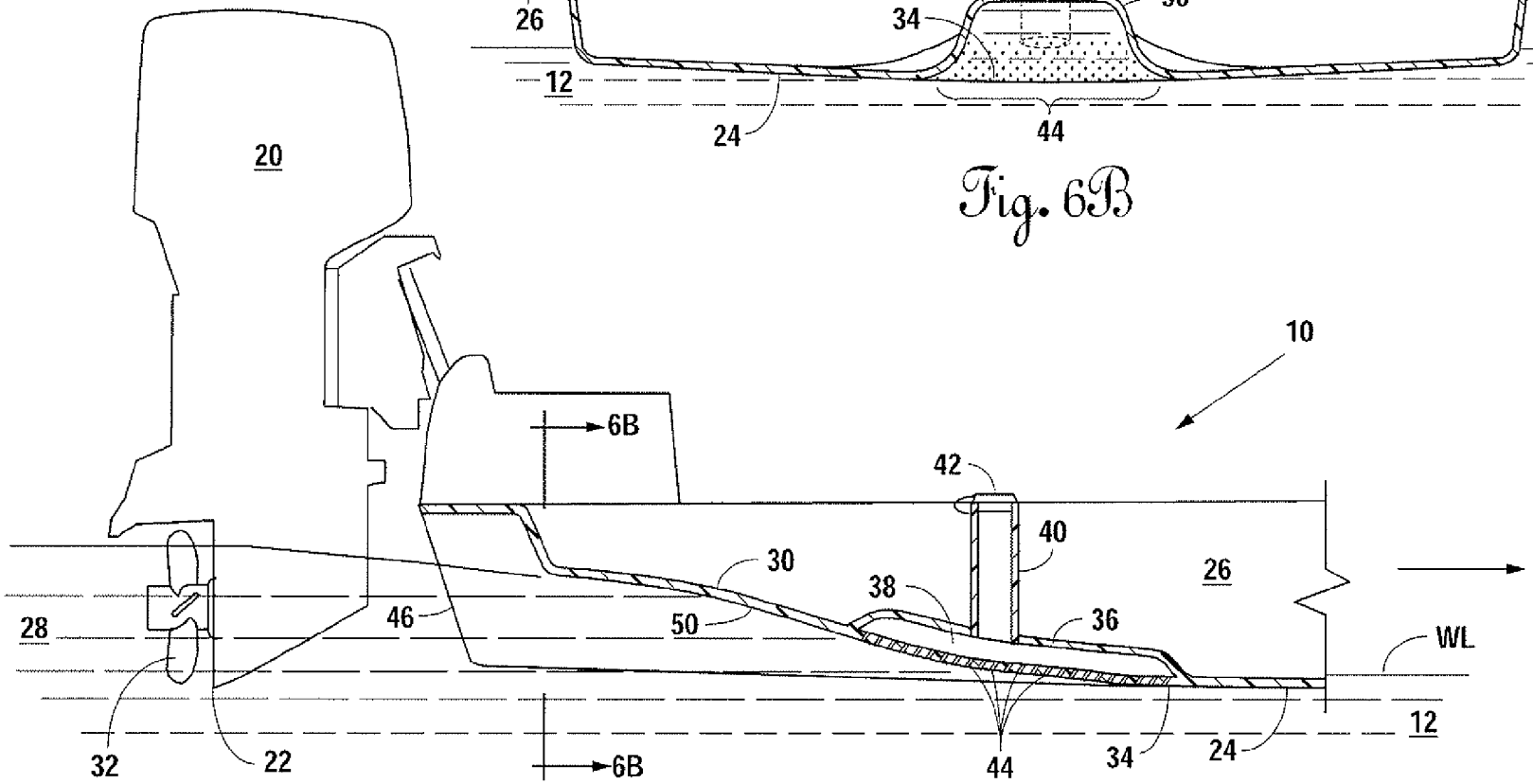
FIG. 6A is a partial longitudinal section view of a boat with the present invention being operated in shallow water, but with the deck removed.

When the shallow draft boat 10 is operated in shallow water 12 and is traveling in the direction indicated in the arrow in FIG. 6A, FIGS. 6A and 6B give a good illustration as to what occurs. The hull 26 barely extends below the water line WL of the shallow water 12 with the bottom 24 barely extending below the water line WL. The outboard motor 20 is raised on the transom 46 so that the lower portion 22 is approximately level with the bottom 24 of the shallow draft boat 10. As the shallow draft boat 10 moves forward, the ridge 28 of shallow water 12 flows through the tunnel 30 and strikes the propeller 32. Air is prevented from being drawn into the angled holes 44, air space 38 and vertical conduit 40 by the placing of the stopper 42 into the end of the vertical conduit 40. As the shallow water 12 flows across the forward end 34 of the tunnel 30, the venturi action on the angled holes 44 cannot draw air because the stopper 42 is in place. This prevents breaking the surface tension and the separation of the shallow water 12 from the top 50 of the tunnel 30. Hence, the shallow water 12 flows upward through the tunnel 30 foiming a ridge 28 of shallow water 12 that strikes the propeller 32. Because the lower portion 22 and propeller 32 of the outboard motor 20 is above the bottom 24 of the shallow draft boat 10, there is no danger of the outboard motor 20 striking solid items below the draft of the shallow draft boat 10. The surface tension between the shallow water 12 and the top 50 of the tunnel 30 will continue to draw the shallow water 12 therethrough to form the ridge 28.

Figure 7:
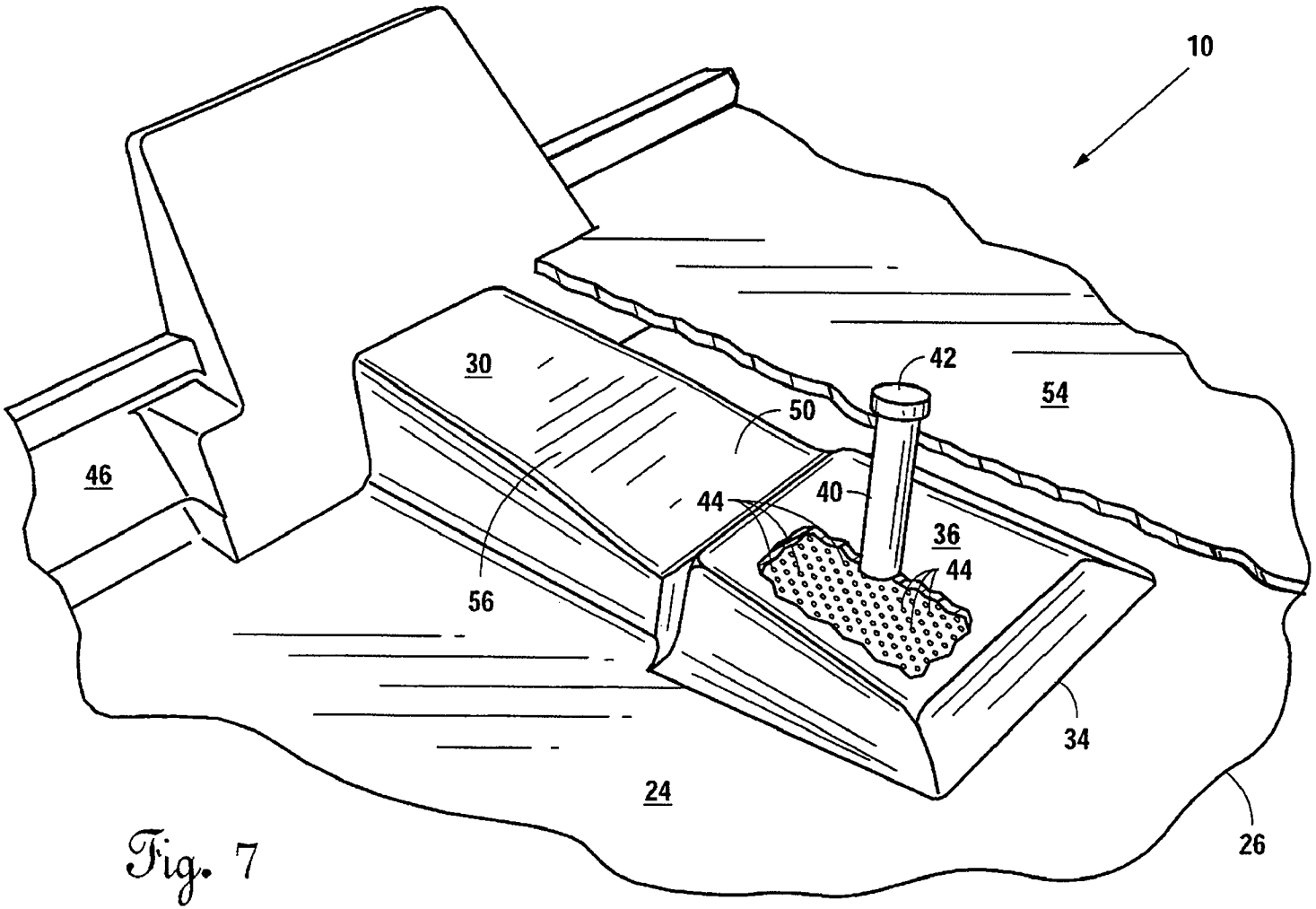
FIG. 7 is a partial perspective view with the deck partially cut away to show the shape of the tunnel and plenum.

Referring now to FIG. 7, a partial perspective view of the shallow draft boat 10 is shown. The deck 54 is cut away to show an upper perspective view of the tunnel 30 with the plenum 36 on the forward end 34 thereof. The transom 46 forms the rear portion of the shallow draft boat 10 and is connected to the bottom 24 of the hull 26. The vertical conduit 40 extends above the plenum 36 and through the deck 54 so that someone on the deck 54 can remove or replace the stopper 42 into the upper end of the vertical conduit 40. The use or non-use of the stopper 42 determines if air can be drawn through the angled holes 44 in the forward end 34 of the tunnel 30.

Figure 8:
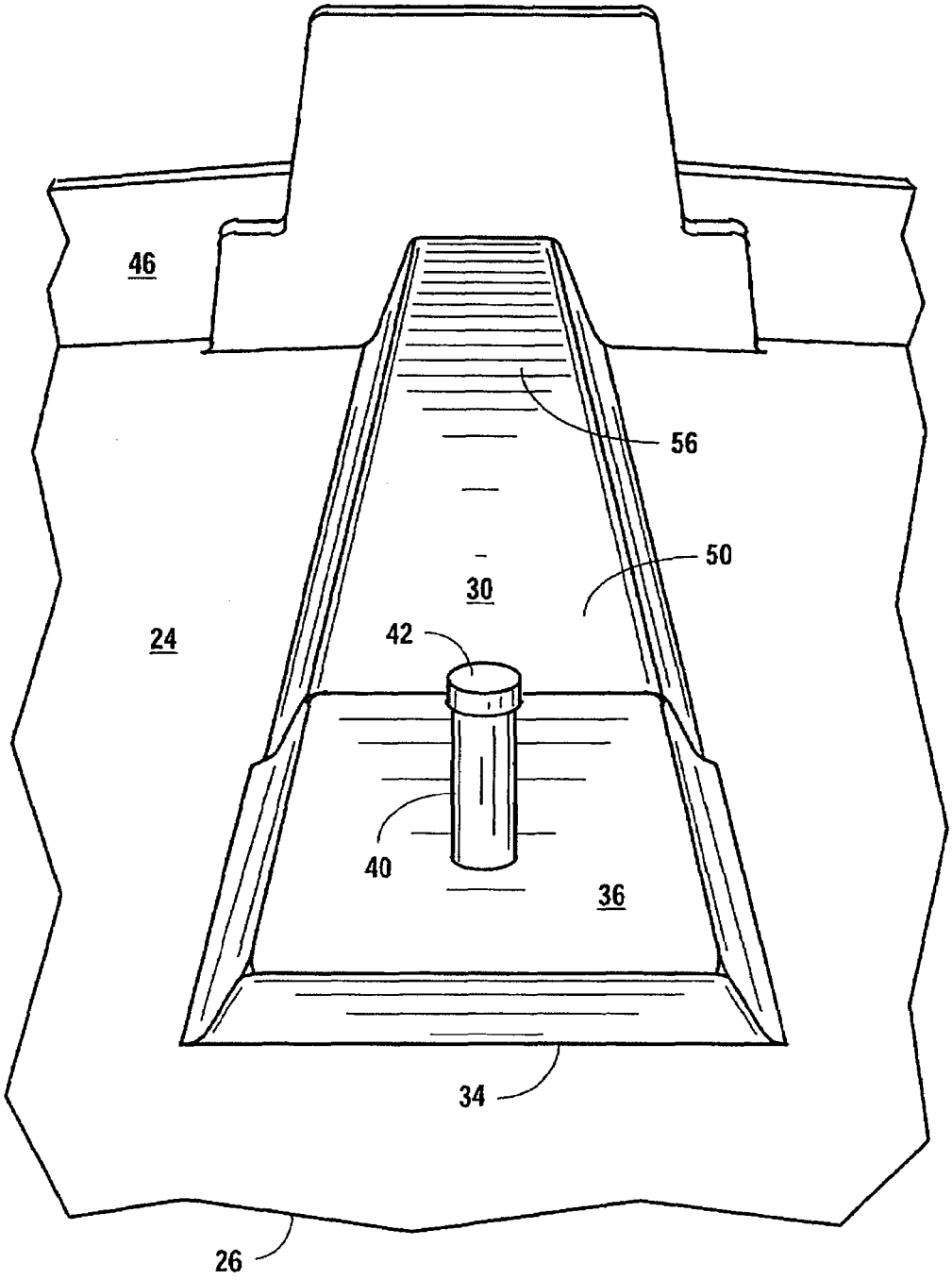
FIG. 8 is a top perspective view showing the shape of the tunnel and plenum, but with the deck removed.

FIG. 8 gives a partial top perspective of the shallow draft boat 10 with the deck 54 removed to illustrate the top surface of the tunnel 30 with the plenum 36. The outboard motor 20 (not shown) would be mounted on the transom 46 that connects to the rear portion of the bottom 24 of the hull 26. The plenum 36 covers the forward end 34 of the tunnel 30 and has the vertical conduit 40 extending thereabove. The removable stopper 42 is in the upper end of the vertical conduit 40. In both FIGS. 7 and 8, the slight S curve 56 in the top 50 of the tunnel 30 is illustrated by the shading. Similarly, the forward portion of the slight S curve can be seen in the partial cross-sectional views of FIGS. 4A, 5A, and 6A. The slight S curve 56 is important because it works with the air being drawn into the venturis caused by water flow over the angled holes 40 to ensure complete separation of the shallow water 12 from the top 50 of the tunnel 30 without doing damage to the ocean floor or the propeller 32. This allows fishermen to get to and maneuver through, some of the best fishing areas in shallow water without doing damage to the ocean floor or the propeller. However, when in deep water, the fisherman can replace the stopper 42, lower the outboard motor 20 and travel to or from the put in or take out points at a good rate of speed with a minimum amount of fuel consumption. When stopper 42 is in place the slight S curve 56 aids in laminar flow of water to the top 50 of the tunnel 30.

I claim:

1. A shallow draft boat for alternatively operating at slower speeds in shallow water or at higher speeds in deep water, said shallow draft boat comprising:

a hull having a bow and a transom aft, said hull having a generally flat bottom;

an outboard motor mounted on said transom, said outboard motor having a raised operating condition and a lowered operating condition;

a tunnel in said generally flat bottom starting near amidship and extending aft through said transom along a centerline of said shallow draft boat, said tunnel having a generally flat top with a S curve shape therein;

a plenum above a forward end of said tunnel connecting via an upper opening to atmosphere;

proliferation of angled openings from said plenum through said forward end of said tunnel to said shallow water or deep water;

a plug for plugging said upper opening to prevent air flow therethrough;

during operation of said shallow draft boat (a) in said shallow water, said outboard motor is in said raised operating condition and said plug plugging said upper opening and (b) in said deep water, said outboard motor is in said lowered operating condition and said plug is removed from said upper opening.

2. The shallow draft boat for alternating operating at slower speeds in shallow water or at higher speeds in deep water as recited in claim 1 further comprising a conduit connecting said plenum to said atmosphere above water line of said shallow draft boat, said plug for plugging said conduit.

3. The shallow draft boat for alternating operating at slower speeds in shallow water or at higher speeds in deep water as recited in claim 2 wherein said angled openings are towards the aft of said shallow water boat so that said deep water flowing thereacross creating a venturi and draws air from atmosphere through said conduit and said plenum into said tunnel to cause separation between said deep water and said tunnel.

4. The shallow draft boat for alternating operating at slower speeds in shallow water or at higher speeds in deep water as recited in claim 3 wherein said tunnel starts near said amidship and increases in depth to said aft of said shallow water boat, said depth at said aft being approximately one half of height of said transom.

5. The shallow draft boat for alternating operating at slower speeds in shallow water or at higher speeds in deep water as recited in claim 3 wherein a leadership edge of said S curve shape starts near said forward end of said tunnel.

6. A method of operating a shallow water boat in either shallow water or in deep water; said shallow water boat having a hull with a bow, a transom aft and a generally flat bottom; a motor mounted on said transom with a raised operating condition and a lowered operating condition; a tunnel in said generally flat bottom starting near amidships extending along a centerline of said shallow water boat, increasing in depth and terminating aft through said transom, said tunnel having a S curve in a top thereof; a plenum above a forward end of said tunnel having numerous angled openings from said plenum into said tunnel; pluggable upper opening from said plenum to atmosphere; said method including the following steps;

during operation in deep water by:

(a) lowering said motor to said lowered operating condition, and (b) unplugging said pluggable upper opening;

alternatively, during operation in shallow water:

(a) raising said motor to said raised operating condition, and (b) plugging said pluggable upper opening.

* * * * *